US007206015B2

(12) United States Patent
Tang et al.

(10) Patent No.: US 7,206,015 B2
(45) Date of Patent: Apr. 17, 2007

(54) LIGHT EMITTING DEVICE DRIVER FOR DRIVING LIGHT EMITTING DEVICE AND INTEGRATED CIRCUIT THEREOF

(75) Inventors: Yih-Wey Tang, Taipei (TW); Yung-Hsin Chiang, Taipei Hsien (TW)

(73) Assignee: ADDtek Corp., Taipei (TW)

( * ) Notice: Subject to any disclaimer, the term of this patent is extended or adjusted under 35 U.S.C. 154(b) by 255 days.

(21) Appl. No.: 10/904,656

(22) Filed: Nov. 22, 2004

(65) Prior Publication Data

US 2006/0022918 A1 Feb. 2, 2006

(30) Foreign Application Priority Data

Jul. 30, 2004 (TW) ..... 93122830 A

(51) Int. Cl.
*B41J 2/45* (2006.01)

(52) U.S. Cl. ..... 347/247; 347/237; 347/132

(58) Field of Classification Search ..... 347/130, 347/132, 237, 247
See application file for complete search history.

(56) References Cited

U.S. PATENT DOCUMENTS 6,538,394 B2 * 3/2003 Volk et al. ..... 315/291
2004/0196221 A1 * 10/2004 Shih ..... 345/82

* cited by examiner

*Primary Examiner*—Huan Tran
(74) *Attorney, Agent, or Firm*—Winston Hsu

(57) ABSTRACT

An integrated circuit includes a light emitting device and a light emitting device driver coupled to the light emitting device. The light emitting device driver is for generating a drive signal to drive the light emitting device to emit light. A light emitting device driver includes a transistor having a first terminal coupled to a light emitting device; a resistor having a first terminal coupled to a second terminal of the transistor, and a second terminal coupled to a supply node; and a comparator having a first input terminal coupled to a reference voltage, a second input terminal coupled to the second terminal of the transistor, and an output terminal coupled to a control terminal of the transistor. The light emitting device driver controls an electrical current flowing through the transistor for driving the light emitting device to emit light.

23 Claims, 7 Drawing Sheets

LIGHT EMITTING DEVICE DRIVER FOR DRIVING LIGHT EMITTING DEVICE AND INTEGRATED CIRCUIT THEREOF

BACKGROUND OF INVENTION

1. Field of the Invention

The invention relates to electronic circuits having light emitting devices, and more particularly, to a light emitting device driver for driving a light emitting device and an integrated circuit integrating a light emitting device and a light emitting device driver.

2. Description of the Prior Art

Light emitting diodes (LEDs) are semiconductor devices that convert electrical energy directly into light. The emitted light is due to the nature of the bonding that occurs in the semiconductor solid. As is well known, the type of bonding in a solid is directly related to the conductivity of the solid. Metals, nonmetals, and semimetals have different bonding properties that lead to the differences in conductivity that can be observed between these categories of elements. LEDs rely on special conductivity properties in order to emit light, and operate by a completely different mechanism from other sources of light, such as light bulbs and the sun.

Furthermore, as LEDs generally produce very little heat, LEDs are much more efficient for producing light than other light sources. Because batteries provide only a limited amount of energy, reduced energy consumption is very beneficial to battery operated portable electronic devices. As such, LEDs are often used as indicator lights or other light sources for portable electronic devices such as mobile phones, notebook computers, personal digital assistants (PDAs), etc.

FIG. 1 shows a schematic diagram of a first typical LED driver circuit driving a plurality of LEDs 110 connected in series to emit light. The first typical LED driver circuit is an inductive boost circuit including an input capacitor 102, a switching regulator 104, an inductor 106, a diode 108, an output capacitor 112, and a load resistor 114. As will be well understood by a person of ordinary skill in the art, the switching regulator 104 charges the inductor 106 at a particular switching frequency to boost an input voltage $V_{IN}$ and thereby generate an output voltage $V_{OUT}$ having a higher voltage. This higher output voltage $V_{OUT}$ is capable of driving the plurality of LEDs 110 connected in series to emit light. A control signal CTRL is used to either enable or disable the switching regulator 104 and thereby turn on or off the plurality of LEDs 110.

FIG. 2 shows a schematic diagram of a second typical LED driver circuit 200 for driving a plurality of LEDs 210 connected in series to emit light. The second typical LED driver circuit 200 is a charge pump circuit including an first capacitor 202, a second capacitor 203, a third capacitor 204, a load resistor 206, and a plurality of switches S1–S4. As will be well understood by a person of ordinary skill in the art, the plurality of switches S1–S4 are toggled at a particular switching frequency to boost an input voltage $V_{IN}$ and thereby generate an output voltage $V_{OUT}$ having a higher voltage. Similar to the first typical LED drvier circuit 100 shown in FIG. 1, the higher output voltage $V_{OUT}$ in FIG. 2 is capable of driving the plurality of LEDs 210 connected in series to emit light.

However, the first and second typical LED driver circuits shown in FIG. 1 and FIG. 2 both suffer from similar problems. These problems include switching noise and high component requirements. More specifically, concerning the switching noise, as the switching regulator 104 or the plurality of switches S1–S4 switch on and off, sudden changes in current drawn from the supply voltages ($V_{IN}$, GND) causes noise to appear on the supply voltages ($V_{IN}$, GND). This switching noise adversely affects other circuit components and must be reduced, particularly in very compact and therefore noise sensitive portable electronic devices such as mobile phones. Additionally, both the inductive boost circuit structure of FIG. 1 and the charge pump circuit structure of FIG. 2 require significant numbers of external components such as capacitors, diodes, and inductors. These external components not only increase the cost and the required implementation size of the circuit, but also increase the overall design complexity and development time of products requiring LEDs.

FIG. 3 shows a typical circuit structure for directly driving a plurality of LEDs 300 to emit light without first boosting an input voltage $V_{IN}$. In this situation, the LEDs 300 are connected in parallel to eliminate the need to boost the input voltage $V_{IN}$. Although the circuit structure of FIG. 3 partially solves the above-mentioned problems, the circuit structure of FIG. 3 is unable to drive the LEDs 300 to emit light when a voltage drop across the resistor 304 plus the forward voltage drop across the parallel combination of LEDs 300 is greater than the input voltage $V_{IN}$. For example, to limit the current flowing through each diode to an appropriate amount, there is typically at least a 0.1 V voltage drop across the resistor 304. Therefore, if low forward voltage LEDs 300 having a forward voltage drop of 3.3V are used, the circuit structure of FIG. 3 will only operate while the input voltage $V_{IN}$ is above 3.4V.

FIG. 4 shows a typical battery discharge graph of battery voltage vs. operating time of a lithium-ion (Li-ion) battery. Li-ion batteries are often used in such portable electronic devices as mobile phones and notebook computers, and as previously mentioned, LEDs are often incorporated into these devices. As shown in FIG. 4, when fully charged, the Li-ion battery has a voltage of approximately 4.1 V. Over time, when about 30% of the energy in the battery is used, the voltage drops to approximately 3.7V; and then when about 80% of the energy in the battery is used, the voltage again begins to significantly drop toward 3.0V. Therefore, assuming a voltage drop across the resistor 304 of 0.1 V, as soon as the voltage of the Li-ion battery drops below 3.4V, indicated at point A in FIG. 4, the LEDs 300 of the circuit of FIG. 3 will no longer emit light. Therefore, the LEDs 300 will not function for the last few percent of Li-ion battery operating time. It would be beneficial to be able to drive LEDs to emit light at lower input voltages ($V_{IN}$) while minimizing external components and avoiding switching noise.

SUMMARY OF INVENTION

One objective of the claimed invention is therefore to provide an integrated circuit including a light emitting device, solve the above-mentioned problems.

According to an exemplary embodiment of the claimed invention, an integrated circuit comprises a light emitting device; and a light emitting device driver coupled to the light emitting device; wherein the light emitting device driver is for generating a drive signal to drive the light emitting device to emit light.

Another objective of the claimed invention is to provide a light emitting device driver that can drive light emitting devices at lower input voltages, to solve the above-mentioned problems.

According to another exemplary embodiment of the claimed invention, a light emitting device driver comprises a transistor having a first terminal coupled to a light emitting device; a resistor having a first terminal coupled to a second terminal of the transistor, and a second terminal coupled to a supply node; and a comparator having a first input terminal coupled to a reference voltage, a second input terminal coupled to the second terminal of the transistor, and an output terminal coupled to a control terminal of the transistor; wherein the light emitting device driver controls an electrical current flowing through the transistor for driving the light emitting device to emit light.

These and other objectives of the present invention will no doubt become obvious to those of ordinary skill in the art after reading the following detailed description of the preferred embodiment that is illustrated in the various figures and drawings.

DETAILED DESCRIPTION

Figure 5:
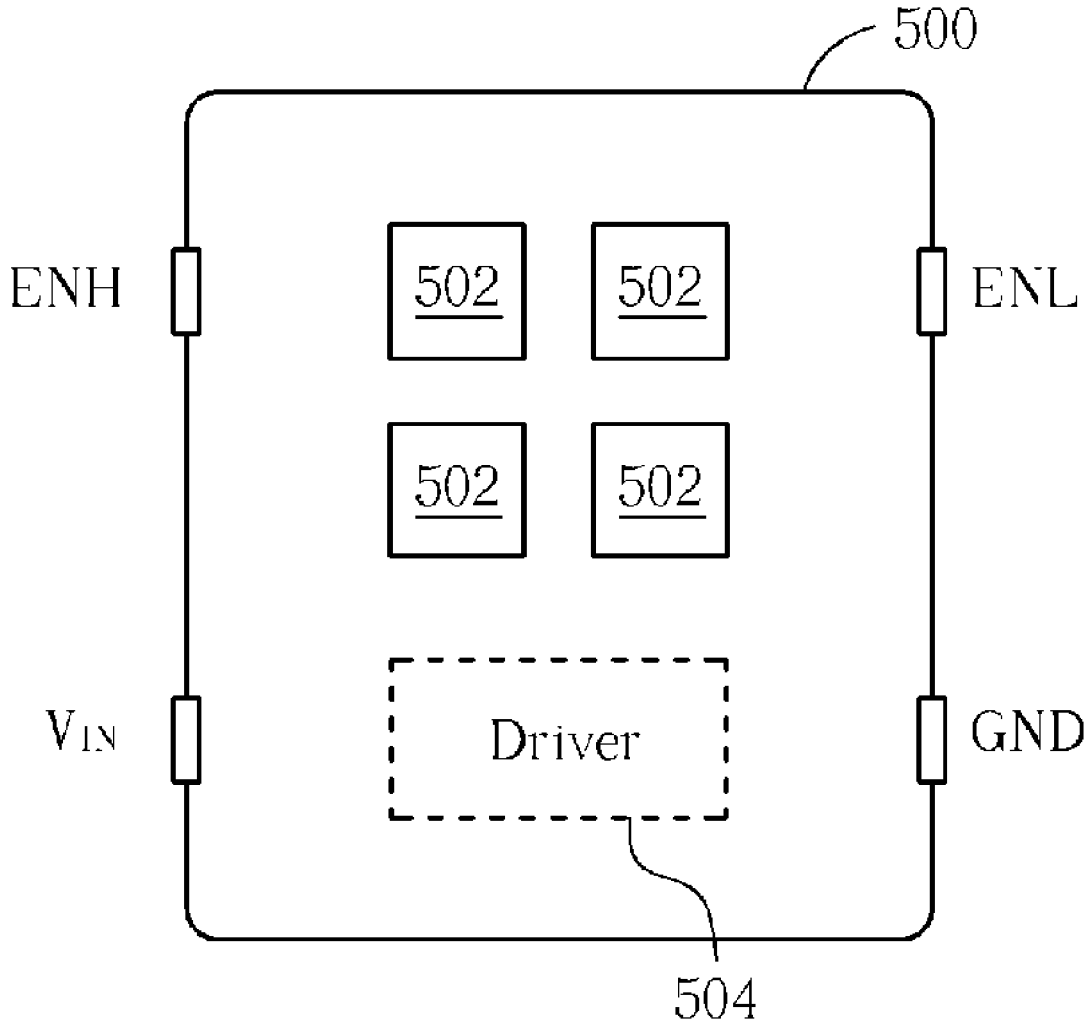
FIG. 5 is an integrated circuit including a plurality of light emitting devices and a light emitting device driver according to an exemplary embodiment of the present invention.

FIG. 5 shows an integrated circuit 500 including a plurality of light emitting devices 502 and an integrated light emitting device driver 504 according to an exemplary embodiment of the present invention. The light emitting device driver 504 is included within the integrated circuit 500 for generating a drive signal to drive the light emitting device to emit light. For example, the light emitting devices 502 could be implemented as light emitting diodes (LEDs) visible from the top of the integrated circuit 500. Additionally, although the integrated circuit 500 shown in FIG. 5 includes a total of four light emitting devices 502, other numbers of light emitting devices 502 could also be used according to the present invention.

By integrating the light emitting devices 502 together with the light emitting device driver circuitry 504 on a single integrated circuit 500, external components are minimized. Therefore, overall circuit design of a device requiring light emitting devices is greatly simplified. Additionally, size requirements to support the light emitting devices 500 is reduced, which is very beneficial to portable electronic devices such as mobile phones, notebook computers, etc. In the exemplary embodiment shown in FIG. 5, only four pins (ENH, ENL, $V_{IN}$, GND) are included on the integrated circuit 500. Of these four pins, Vin and GND are both supply voltages that are externally coupled to supply nodes of the device into which the integrated circuit 500 is installed. The pins ENH and ENL correspond to input enable signals used to control different modes of the LEDs 502. In this embodiment, because there are two enable signals (ENH, ENL), up to four modes can be controlled. As will be understood by a person of ordinary skill in the art, other embodiments having different numbers of enable signals can also be implemented according to the present invention. In general, the number of different controllable modes is equal to the number of enable signals to the power of two.

Figure 6:
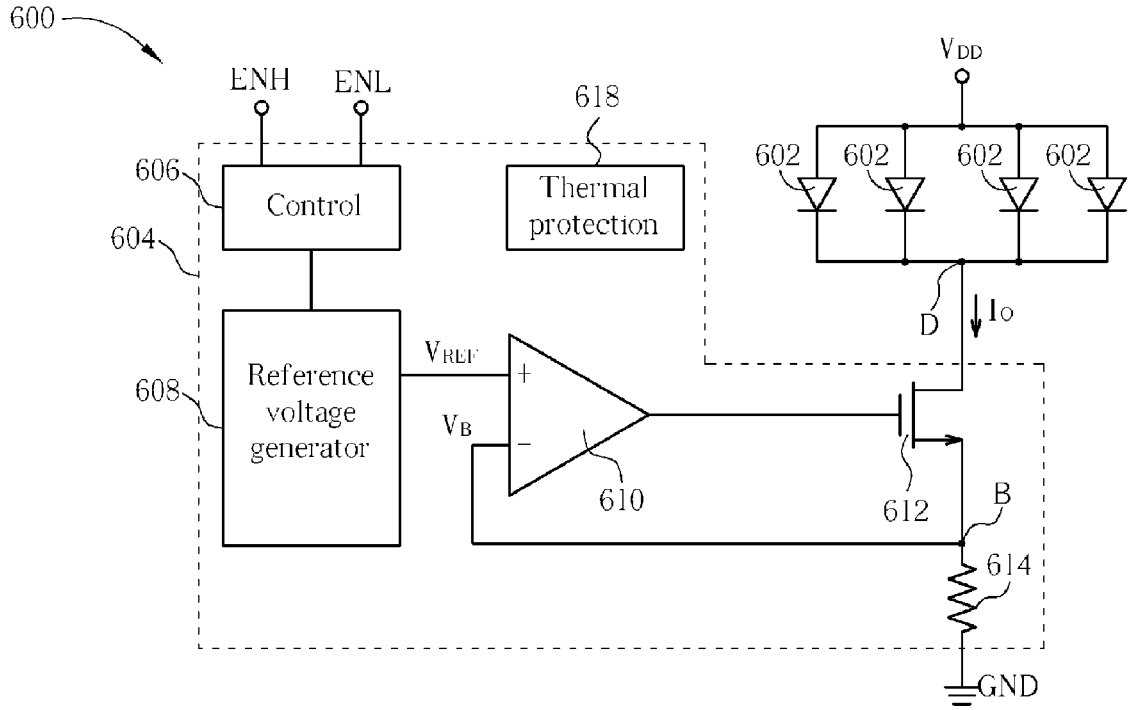
FIG. 6 is a block diagram of a first integrated circuit according to a first exemplary embodiment of the present invention.

FIG. 6 shows a block diagram of a first integrated circuit 600 according to a first exemplary embodiment of the present invention. As shown in FIG. 6, the integrated circuit 600 includes a light emitting device driver 604 and a plurality of four light emitting devices implemented as LEDs 602. It should also first be noted that although the block diagram shown in FIG. 6 is particularly advantageous for reasons that will be explained, other embodiments of light emitting devices 502 and light emitting device drivers 504 implemented on a single integrated circuit 500 are also possible according to the present invention. For example, in FIG. 6, although four LEDs 602 are shown in FIG. 6, other numbers of LEDs 602 could also be used according to the present invention. In this embodiment, the light emitting device driver 604 includes a control unit 606, a reference voltage generator 608, a comparator 610, a transistor 612, a resistor 614, and a thermal protection circuit 618. For illustration purposes, in this embodiment, the comparator 610 is implemented as an operational amplifier 610.

The control unit 606 receives a first enable signal ENH and a second enable signal ENL for controlling different modes of the LEDs 602. In this embodiment, the control unit 606 controls the reference voltage generator 608 to output a particular valued reference voltage $V_{REF}$ according to a mode specified by the first and second enable signals ENH, ENL. The comparator 610 compares the reference voltage $V_{REF}$ with a voltage $V_B$, where the voltage $V_B$ corresponds to the voltage level at a node B. More specifically, the voltage $V_B$ is the voltage drop across the resistor 614. According to the comparison result between $V_{REF}$ and $V_B$, the comparator 610 adjusts the voltage level at the control terminal of the transistor 612. For example, in the embodiment shown in FIG. 6, if $V_{REF}$ is greater than $V_B$, the comparator 610 increases the voltage level at the control terminal of the transistor 612. The transistor 612 acts as an adjustable current source and draws a current $I_O$ through the parallel combination of LEDs 602. As the current $I_O$ is increased, the intensity of light emitted by the LEDs 602 and the voltage $V_B$ across the resistor 614 are both increased. Likewise, as the current $I_O$ is decreased, the intensity of light emitting by the LEDs 602 and the voltage $V_B$ across the resistor 614 are both decreased. The circuit structure of the light emitting device driver 604 ensures the voltage across the resistor 614 (i.e., the voltage $V_B$) is substantially equal to the reference voltage $V_{REF}$.

In this embodiment, the different modes of the LEDs 602 controlled by the enable signals ENH, ENL correspond to different intensities of light emitted by the LEDs 602. As mentioned above, the control unit 606 controls the reference voltage generator 608 to output a particular reference voltage $V_{REF}$ according to a mode specified by the first and second enable signals ENH, ENL. Each particular reference voltage $V_{REF}$ then causes a particular current $I_O$ to be drawn through the parallel combination of LEDs 602. In this way, different intensities of light emitted by the LEDs 602 are selected according to the enable signals ENH, ENL. The following mode table shows an example mapping between values of the enable signals ENH, ENL to different modes of the LEDs 602 according to one exemplary embodiment of the present invention.

| ENH | ENL | $V_{REF}$ | $I_O$ | MODE |
|---|---|---|---|---|
| 0 | 0 | 0 mV | 0 mA | Disabled |
| 0 | 1 | 10 mV | 20 mA | Indicator signal |
| 1 | 0 | 30 mV | 60 mA | Flashlight function |
| 1 | 1 | 60 mV | 120 mA | Strobe flash for picture taking |

The values of the above mode table are designed for use with white light LEDs on a portable electronic device such as a handheld mobile phone. However, it should also be noted that the above mode table is only meant as an example of one possible implementation of the present invention, and the present invention is not limited to only the stated values or modes.

Figure 1:
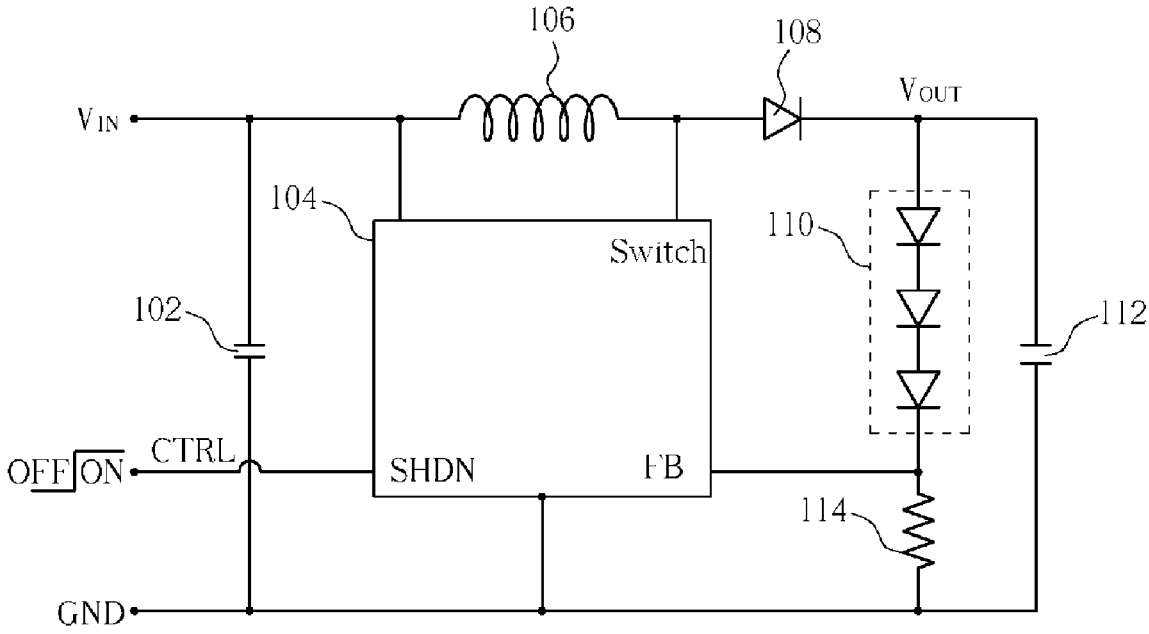
Fig. 1 Related art
FIG. 1 is a schematic diagram of a first typical LED driver circuit driving a plurality of LEDs to emit light.
Figure 2:
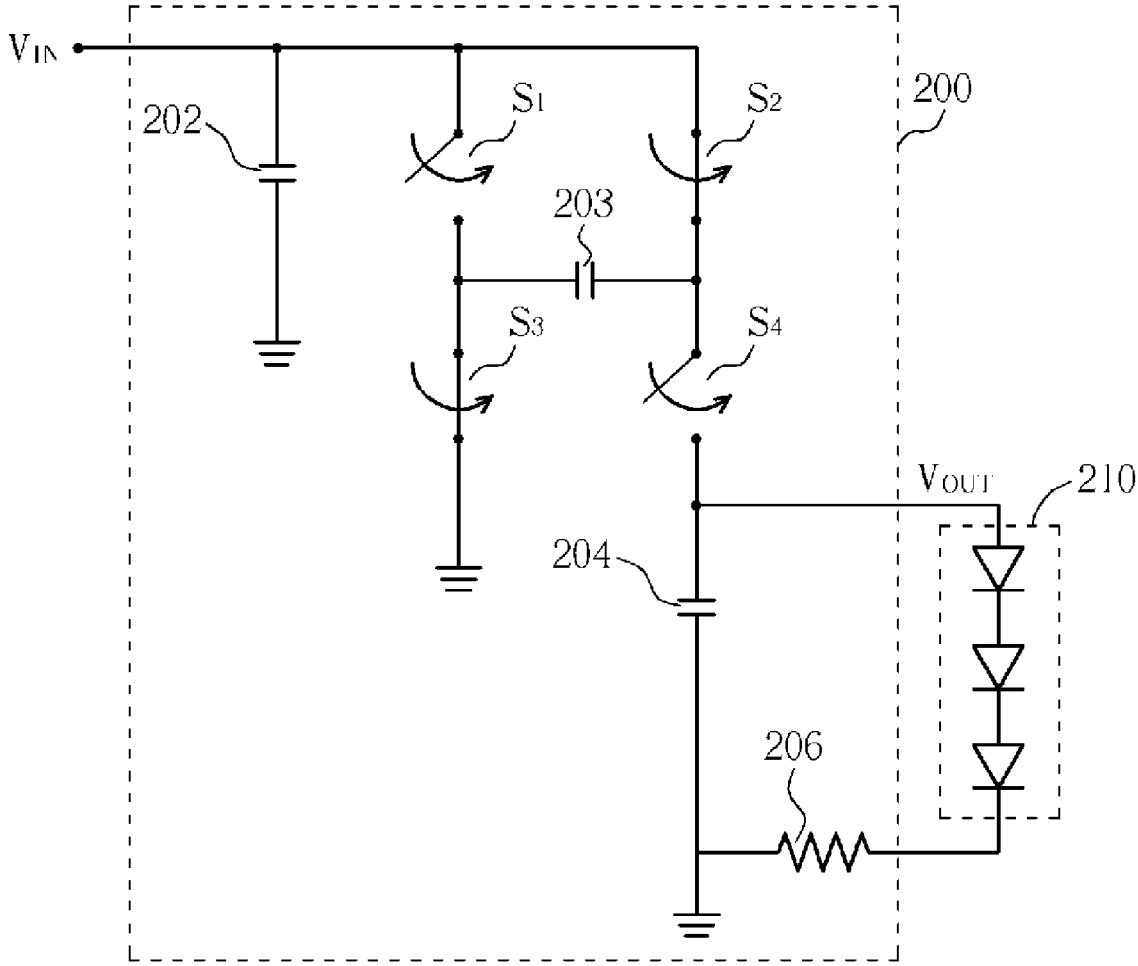
Fig. 2 Related art
FIG. 2 is a schematic diagram of a second typical LED driver circuit for driving a plurality of LEDs to emit light.
Figure 3:
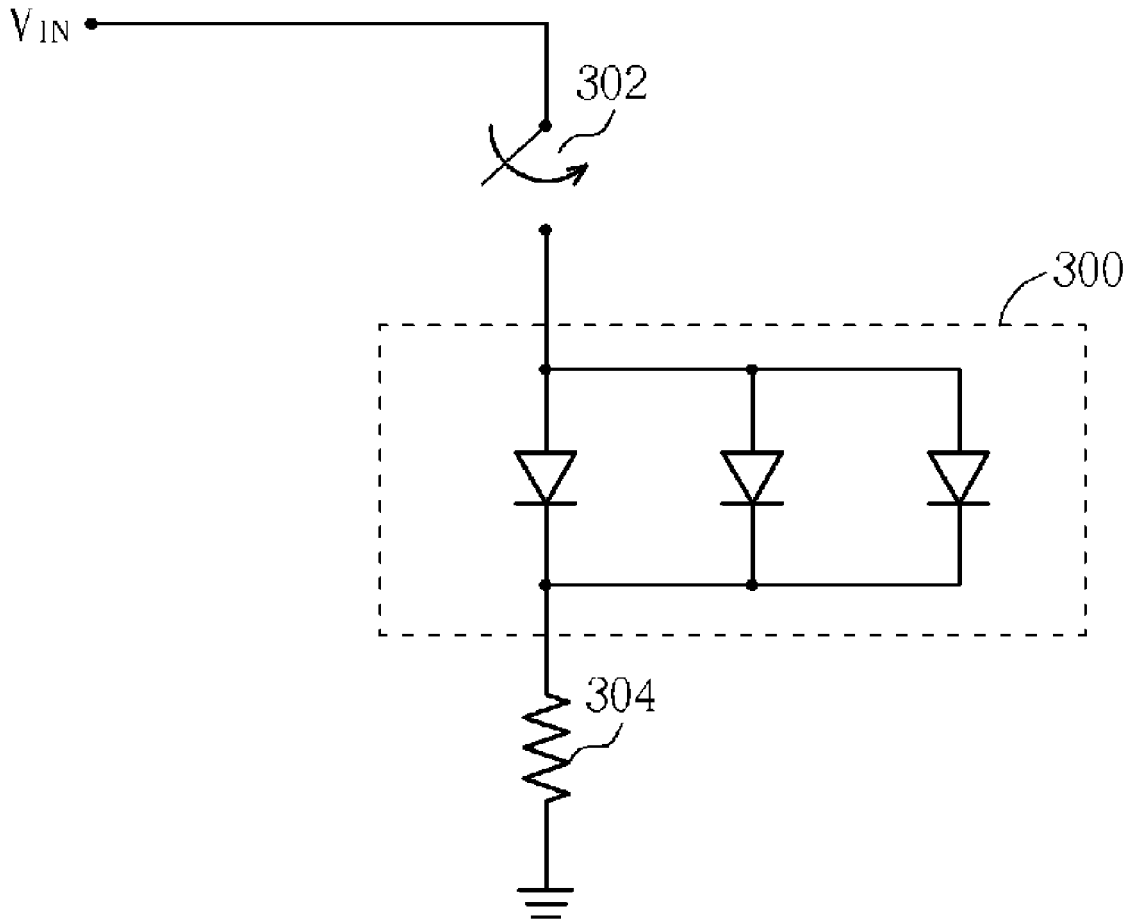
Fig. 3 Related art
FIG. 3 is a schematic diagram showing a typical circuit structure for directly driving a plurality of LEDs to emit light without first boosting an input voltage $V_{IN}$.
Figure 4:
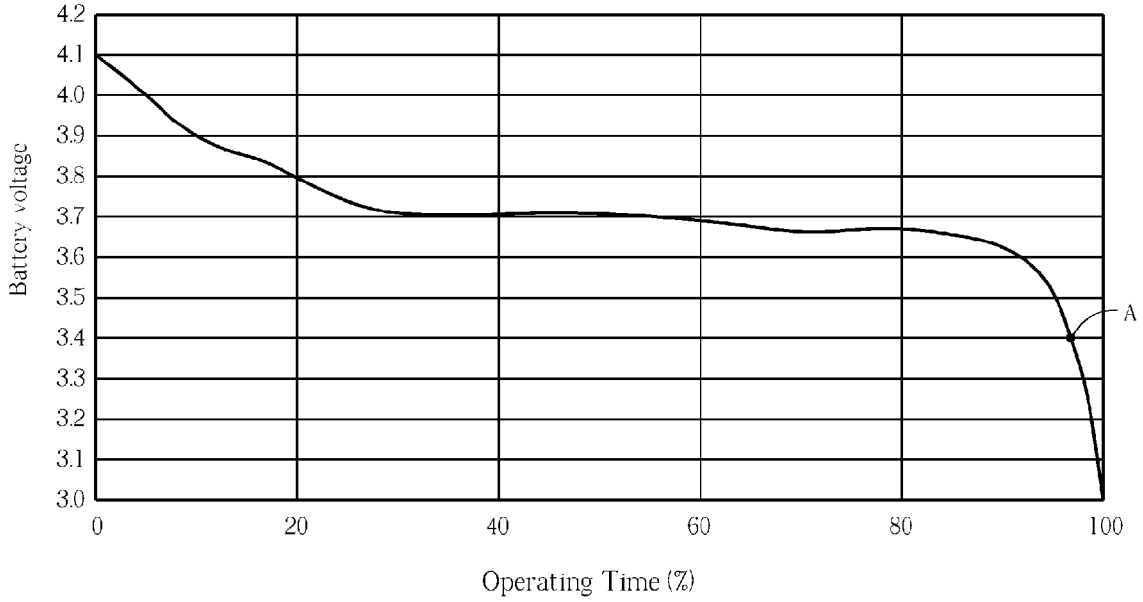
Fig. 4 Related art
FIG. 4 is a typical battery discharge graph of battery voltage vs. operating time of a lithium ion (Li-ion) battery.

The circuit structure of the first integrated circuit 600 according to the embodiment shown in FIG. 6 does not perform power supply boosting of the VDD supply voltage in order to drive the LEDs 602. Therefore, switching noise on the power supply rails is eliminated. Additionally, there is a very low voltage drop $V_B$ across the resistor 614. This is very beneficial to battery operated devices requiring LED operation at low battery levels. For example, as shown by the values of the above-mentioned mode table, to operate as an indicator signal, the voltage reference signal $V_{REF}$ is only 10 mV. Therefore, because of the circuit structure operation explained above, the voltage drop $V_B$ across the resistor 614 will also be substantially equal to 10 mV. If the LEDs 602 are implemented using low forward voltage LEDs having a forward voltage of 3.3V, the first integrated circuit 600 can successfully drive the LEDs 602 to emit light until the supply voltage VDD drops to a level of 3.31 V. As can be seen from the typical Li-ion battery discharge graph of FIG. 4, the light emitting device driver 604 according to the present invention increases the operating time of the LEDs 602.

As mentioned, the light emitting device driver 604 also includes a thermal protection circuit 618. The purpose of the thermal protection circuit 618 is to ensure that the LEDs 602 are not damaged due to excessive heat emission. This could occur, for example, by having a prolonged duration of time at a high intensity light mode such as the "Strobe flash for picture taking" mentioned in the above example mode table. To avoid burning out the LEDs 602, the thermal protection circuit 618 measures a temperature corresponding to a current LED 602 running temperature. If the temperature measured by the thermal protection circuit 618 exceeds a first predetermined threshold, the thermal protection circuit 618 disables the LEDs 602 to prevent damage due to excessive temperature. When the temperature falls to a second predetermined threshold, the thermal protection circuit 618 re-enables the LEDs 602. Alternatively, in anther embodiment, if the temperature measured by the thermal protection circuit 618 exceeds the first predetermined threshold, the thermal protection circuit 618 reduces the intensity of light emitted by the LEDs 602 to prevent damage due to excessive temperature at the higher intensity. In this embodiment, when the temperature falls to the second predetermined threshold, the thermal protection circuit 618 re-enables the LEDs 602 at the higher intensity.

To ensure that the intensity of emitted light at each of the modes in the above mentioned mode table does not drift over time, in another embodiment of the present invention, the resistor 614 shown in FIG. 6 is implemented using a resistor 614 having a negative temperature coefficient and is located within a predetermined distance to the parallel combination of LEDs 602. The reasoning behind this embodiment is that the LEDs 602 have a positive temperature coefficient. That is, as the temperature of the LEDs 602 increases, the current $I_O$ tends to decrease and the intensity of the light emitted by the LEDs likewise tends to decrease. By locating the resistor 614 in a close proximity to the LEDs 602, the positive temperature coefficient of the LEDs 602 will tend to cancel with the negative temperature coefficient of the resistor 614. Therefore, in this embodiment, the intensity of the light emitted by the LEDs 602 remains substantially constant over time at each of the mode selections.

Figure 7:
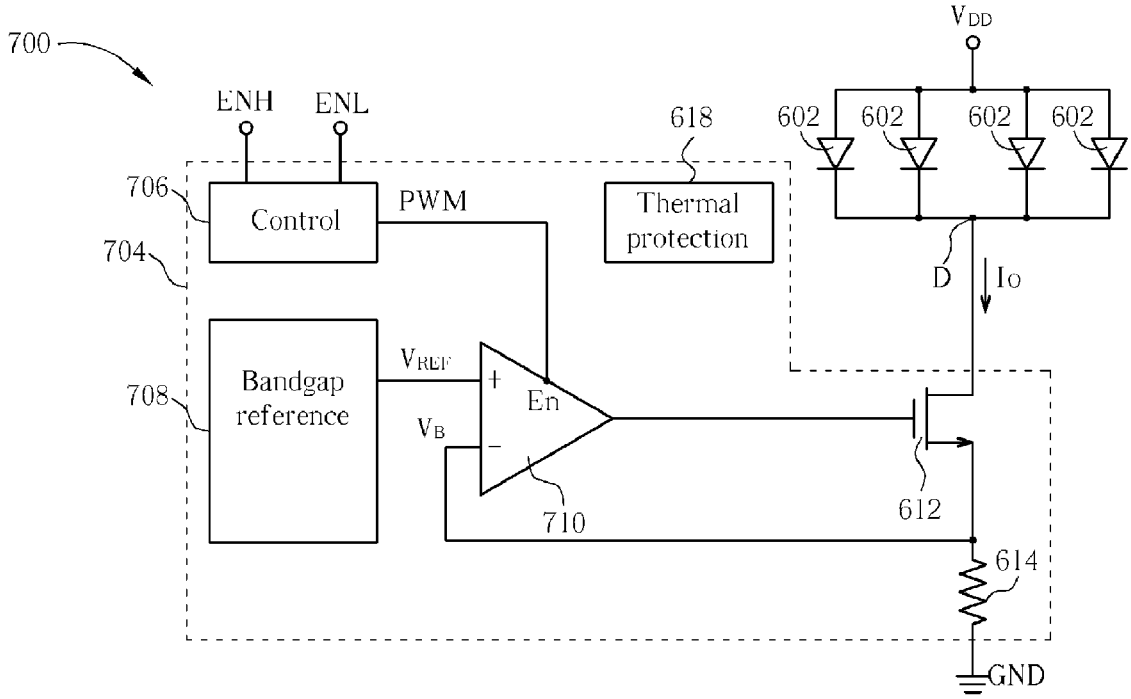
FIG. 7 is a block diagram of a second integrated circuit according to a second exemplary embodiment of the present invention.

FIG. 7 shows a block diagram of a second integrated circuit 700 according to a second exemplary embodiment of the present invention. As shown in FIG. 7, the integrated circuit 700 includes a light emitting device driver 704 and the plurality of four light emitting devices implemented as LEDs 602. Similar to previously mentioned, although four LEDs 602 are again shown in FIG. 7, other numbers of LEDs 602 could also be used according to the present invention. Similar to FIG. 6, in FIG. 7 the light emitting device driver 704 includes the transistor 612, the resistor 614, and the thermal protection circuit 618. These components have substantially the same connections and operation as previously described for FIG. 6. Additionally, the second integrated circuit 700 also includes a control unit 706, a constant reference voltage generator being implemented as a bandgap reference generator 708, and a comparator 710. As shown, the comparator 710 in this embodiment is implemented as an operational amplifier 710 including an enable terminal En.

Similar to the first embodiment shown in FIG. 7, the control unit 706 receives a first enable signal ENH and a second enable signal ENL for controlling different modes of the LEDs 602. In this embodiment, the bandgap reference generator 708 generates a constant reference voltage at a predetermined voltage level. Using the example mode table shown above, the predetermined voltage level could be a value of 60 mV. That is, in this embodiment, the predetermined voltage level corresponds to the voltage required at the highest intensity mode such as the "Strobe flash for picture taking" mode. The control unit 706 generates a pulse width modulated signal PWM having a duty cycle corresponding to a mode specified by the first and second enable signals ENH, ENL. The pulse width modulated signal PWM is connected to the enable terminal En of the comparator 710. In this way, except when a disable mode is selected, the control unit 706 alternatively enables and disables the comparator 710 with a particular duty cycle. The duty cycle corresponds to the particular mode selected by the first and second enable signal ENH, ENL. When the disable mode is selected, the control unit 706 holds the comparator 710 in the disabled state.

When enabled by the pulse width modulated signal PWM, similar to the embodiment shown in FIG. 6, the comparator 710 compares the reference voltage $V_{REF}$ with a voltage $V_B$, where the voltage $V_B$ corresponds to the voltage drop across the resistor 614. According to the comparison result between $V_{REF}$ and $V_B$, the comparator 710 adjusts the voltage level at the control terminal of the transistor 612. As in the previous embodiment, the transistor 612 acts as an adjustable current source and draws a current $I_O$ through the parallel combination of LEDs 602. More specifically, the control unit 706 turns on and off the current $I_O$ according to the duty cycle of the pulse width modulated signal PWM. When the current $I_O$ is turned on, the LEDs 602 emit light; and when the current $I_O$ is turned off, the LEDs 602 are disabled. In this way, by alternating the duty cycle of the turned on time and turned off time, the control unit 706 controls the intensity of the light emitted by the LEDs 602.

Similar to the first integrated circuit 600 shown in FIG. 6, the second integrated circuit 700 shown in FIG. 7 does not perform power supply boosting of the VDD supply voltage in order to drive the LEDs 602. Therefore, switching noise on the power supply rails is eliminated. Additionally, there is a very low voltage drop $V_B$ across the resistor 614, which extends LED 602 operation at lower battery levels. To reduce variations in emitted light intensity at each mode, similar to previously explained for the circuit shown in FIG. 6, in an additional embodiment of the second integrated circuit 700, the resistor 614 is located within a predetermined distance of the LEDs 602.

It should also be noted that other embodiments of the present invention are also possible. For example, although the integrated circuits 600 and 700 of FIG. 6 and FIG. 7, respectively, show an n-type transistor 612, as will be easily observed by a person of ordinary skill in the art, other embodiments of the present invention utilizing p-type transistors are also possible. Additionally, although in a preferred embodiment of the present invention the light emitting device and the light emitting device driver are integrated together on a single integrated circuit, other embodiments are also possible where the light emitting device and the light emitting device driver are implemented on separate integrated circuits. By using the circuit structure of the light emitting device drivers 604, 704, operation of the light emitting devices 602 is extended at lower battery levels.

The present invention includes a light emitting device and a light emitting device driver coupled to the light emitting device. The light emitting device driver is for generating a drive signal to drive the light emitting device to emit light. A light emitting device driver includes a transistor having a first terminal coupled to a light emitting device; a resistor having a first terminal coupled to a second terminal of the transistor, and a second terminal coupled to a supply node; and a comparator having a first input terminal coupled to a reference voltage, a second input terminal coupled to the second terminal of the transistor, and an output terminal coupled to a control terminal of the transistor. The light emitting device driver controls an electrical current flowing through the transistor for driving the light emitting device to emit light. In this way, switching noise on power supply rails is eliminated, and the light emitting device driver is able to drive the light emitting device to emit light at low battery voltages. By integrating the light emitting device and the light emitting device driver together on a single integrated circuit, external components are minimized, required implementation size is reduced, cost is reduced, and the overall circuit design is simplified. To reduce variations in emitted light intensity at different modes, the resistor of the light emitting device driver can be implemented having a negative temperature coefficient and placed near the light emitting device. Additionally, a thermal protection circuit can also be included to protect against damage to the light emitting device from high temperatures.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An integrated circuit comprising:

a light emitting device, and a light emitting device driver coupled to the light emitting device, the light emitting device driver including:

a transistor having a first terminal coupled to the light emitting device;

a resistor having a first terminal coupled to a second terminal of the transistor, and a second terminal coupled to a supply node; and a comparator having a first input terminal coupled to a reference voltage, a second input terminal coupled to the second terminal of the transistor, and an output terminal coupled to a control terminal of the transistor;

wherein the light emitting device driver is for generating a drive signal to drive the light emitting device to emit light, and the drive signal is an electrical current flowing through the transistor.

2. The integrated circuit of claim 1, wherein the light emitting device driver further comprises a reference voltage generator for generating the reference voltage according to a control signal to control different values of the drive signal.

3. The integrated circuit of claim 1, wherein the resistor has a negative temperature coefficient.

4. The integrated circuit of claim 3, wherein the resistor is located within a predetermined distance to the light emitting device.

5. The integrated circuit of claim 1, wherein the light emitting device is a light emitting diode (LED).

6. The integrated circuit of claim 1, wherein the integrated circuit further comprises a plurality of light emitting devices; and the drive signal generated by the light emitting device driver is further coupled to each of the light emitting devices for driving the light emitting devices to emit light according to a control signal.

7. The integrated circuit of claim 1, further comprising a thermal protection circuit for measuring a temperature corresponding to the light emitting device, wherein if the temperature exceeds a threshold, the thermal protection circuit disables the light emitting device or reduces an intensity of light emitted by the light emitting device.

8. An integrated circuit comprising:

a light emitting device; and a light emitting device driver coupled to the light emitting device;

wherein the light emitting device driver is for generating a drive signal to drive the light emitting device to emit light, and the drive signal generated by the light emitting device driver comprises a plurality of values for controlling a plurality of modes of the light emitting device.

9. The integrated circuit of claim 8, wherein the modes comprise a plurality of different intensities of light emitted by the light emitting device; and the light emitting device driver modifies the value of the drive signal being an electrical current signal or an electrical voltage signal according to a particular mode indicated by the control signal.

10. The integrated circuit of claim 8, wherein the modes comprise a plurality of different intensities of light emitted by the light emitting device; and the light emitting device driver pulse width modulates the drive signal according to a particular mode indicated by the control signal.

11. The integrated circuit of claim 8, wherein the light emitting device is a light emitting diode (LED).

12. The integrated circuit of claim 8, wherein the integrated circuit further comprises a plurality of light emitting devices; and the drive signal generated by the light emitting device driver is further coupled to each of the light emitting devices for driving the light emitting devices to emit light according to a control signal.

13. The integrated circuit of claim 8, further comprising a thermal protection circuit for measuring a temperature corresponding to the light emitting device, wherein if the temperature exceeds a threshold, the thermal protection circuit disables the light emitting device or reduces an intensity of light emitted by the light emitting device.

14. A light emitting device driver comprising:

a transistor having a first terminal coupled to a light emitting device;

a resistor having a first terminal coupled to a second terminal of the transistor, and a second terminal coupled to a supply node; and a comparator having a first input terminal coupled to a reference voltage, a second input terminal coupled to the second terminal of the transistor, and an output terminal coupled to a control terminal of the transistor;

wherein the light emitting device driver controls an electrical current flowing through the transistor for driving the light emitting device to emit light.

15. The light emitting device driver of claim 14, wherein the resistor has a negative temperature coefficient.

16. The light emitting device driver of claim 15, wherein the resistor is located within a predetermined distance to the light emitting device.

17. The light emitting device driver of claim 14, wherein the light emitting device driver further comprises a reference voltage generator for generating the reference voltage according to a control signal to control different values of the electrical current flowing through the transistor; the different values of the electrical current corresponding to different modes of the light emitting device.

18. The light emitting device driver of claim 17, wherein the modes comprise a plurality of different intensities of light emitted by the light emitting device; and the reference voltage generator modifies the value of the reference voltage according to a particular mode indicated by the control signal.

19. The light emitting device driver of claim 14, wherein the light emitting device driver further comprises a control unit for pulse width modulating an enabling signal for the comparator to control different values of the electrical current flowing through the transistor according to a control signal.

20. The light emitting device driver of claim 14, wherein the light emitting device is a light emitting diode (LED).

21. The light emitting device driver of claim 14, being further coupled to a plurality of light emitting devices for driving the light emitting devices to emit light according to the control signal.

22. The light emitting device driver of claim 14, further comprising a thermal protection circuit for measuring a temperature corresponding to the light emitting device, wherein if the temperature exceeds a threshold, the thermal protection circuit disables the light emitting device or reduces an intensity of light emitted by the light emitting device.

23. The light emitting device driver of claim 14, being included together with the light emitting device in a single integrated circuit.

* * * * *